US005700006A

United States Patent [19]

Sekiya et al.

[11] Patent Number: 5,700,006

[45] Date of Patent: Dec. 23, 1997

[54] SHEET FEEDING APPARATUS WITH SUSPENDED SHEET CARRYING DEVICE AND IMAGE FORMING APPARATUS

[75] Inventors: Harukazu Sekiya; Jun Saito, both of Kawasaki; Yuzo Isoda, Yokohama; Yasuhiro Uchida, Tokyo; Makoto Izumi, Yokohama; Takashi Kuwata, Kawasaki, all of Japan

[73] Assignee: Canon Kabushiki Kaisha, Tokyo, Japan

[21] Appl. No.: 557,273

[22] Filed: Nov. 14, 1995

[30] Foreign Application Priority Data

Nov. 14, 1994 [JP] Japan ..... 6-278800

[51] Int. Cl.[6] ..... B65H 9/12

[52] U.S. Cl. ..... 271/241; 271/250; 271/147

[58] Field of Search ..... 271/147, 152, 271/154–157, 241, 248, 250

[56] References Cited

U.S. PATENT DOCUMENTS

| | | | |
|---|---|---|---|
| 2,950,107 | 8/1960 | Royer | 271/154 |
| 3,097,760 | 7/1963 | Short | 271/155 X |

FOREIGN PATENT DOCUMENTS

| | | | |
|---|---|---|---|
| 1146507 | 4/1963 | Germany | 271/155 |
| 128826 | 5/1991 | Japan | 271/157 |

OTHER PUBLICATIONS

Oagley, J.R. "Elevator Wire Pulley" Xerox Disclosure Bull., vol. 5, No. 4, Jul./Aug. 1980, p. 379.

*Primary Examiner*—Boris Milef

*Attorney, Agent, or Firm*—Fitzpatrick, Cella, Harper & Scinto

[57] ABSTRACT

This invention relates to a sheet feeding apparatus having sheet carrying device unit for carrying sheets suspended by suspending unit, which is taken up by winding unit and thereby moves the sheet carrying device up and down to render the sheets fed from the topmost side of the sheets. Connection positions between the suspending unit and the sheet carrying device are located, in a direction perpendicular to a feeding direction of the sheets, at positions on a side of the sheet reference which is one end in the direction perpendicular to the feeding direction of the sheets, closer to the center of the sheets with respect to a position of a suspending original point of the suspending unit located over the sheet carrying device. The other connection positions between the suspending unit and the sheet carrying device are located, in a direction perpendicular to a feeding direction of the sheets, at a position on a side opposite to the side of the sheet reference, remote from the center of the sheets with respect to a position of a suspending original point of the suspending unit located over the sheet carrying device.

14 Claims, 12 Drawing Sheets

SHEET FEEDING APPARATUS WITH SUSPENDED SHEET CARRYING DEVICE AND IMAGE FORMING APPARATUS

BACKGROUND OF THE INVENTION

1. Field of the Invention

This invention relates to a sheet feeding apparatus capable of feeding sheets to image forming apparatuses such as laser printers, photocopiers, and the like.

2. Description of Related Art

Referring to FIGS. 10 to 12, a conventional sheet feeding apparatus installed in an image forming apparatus such as a photocopier is described. In FIG. 10, an image forming apparatus 102 serving as a known laser printer is mounted on the top of the sheet feeding apparatus 101, which conveys sheets to the image forming apparatus 102.

The sheet feeding apparatus 101 includes a tray 103 movable up and down in carrying sheets S, a storage 104 incorporating the tray 103 and slidable to put the sheets on the tray 103, a frame 108 formed with guides 105 supporting the storage 104 for sliding movements of the storage 104 and with feeding means for feeding the sheets S on the tray 103 (i.e., a pickup roller 106, retard roller pair 107), and a conveyer 109 for feeding the sheets S to the image forming apparatus 102.

Within the storage 104, as shown in FIG. 12, the tray 103 for carrying the sheets S is suspended by four wires 110*a* to 110*d* secured to four corners of the tray 103. The other end of each wire is connected to either one of two winding winches provided on front and rear sides by way of four pulleys 112*a* to 112*d*, each of which is rotatably held by respective one of pulley shafts 111*a* to 111*d* which are secured to the storage 104.

The winding winches 113 are fixed onto a single shaft 113*a* to which a gear 113*b* is attached. Where the storage 104 is set in the frame 108, the winches 113 are operatively engaged with the gear of a motor M mounted on the frame 108 and are rotated upon drive of the motor M, thereby lifting the tray 103 by winding the respective wires around respective bodies of the winches 113. By drawing the storage 104 from the frame 108, the gear 113*b* of the winding winch 113 mounted on the storage 104 is disengaged from the gear of the motor M secured to the frame 108, so that the tray 103 moves down by the virtue of the weight of the tray 103 and the sheets S.

Detecting means is attached to the frame 108 for detecting the top face of the tray (or sheets S) which is going up. If the detecting means detects the top face of the tray (or sheets S) going up, the motor M for driving the winding winches is stopped. If the sheet's top is lowered by feeding sheets S on the tray 103 out in use of feeding means mounted on the frame 108, the tray 103 is lifted until the detecting means detects the sheet's top.

The pulley by way of which each wire is tensioned is placed so that a contact point between the pulley and the wire is set at a position on a perpendicular line from the fixed point between the wire and the tray 103, and the tray 103 is suspended by the wires so as not to contact with the storage 104. In another feature, the wire may be wound up in the axial direction of the winding winch 113, and the pulley may be attached movably in the axial direction of the pulley so that the wire is free from stress even if the wire moves in the axial direction of the winding winch.

In FIG. 11, a sheet reference plate 114 for providing a sheet positional standard in a direction perpendicular to the feeding direction of the sheets S, is attached to the storage 104 so as to pass through an opening formed in the tray 103 to avoid interferences with moving up and down of the tray 103. A sheet shifting plate 115 for shifting the sheets toward the sheet reference plate 114 by pushing an end opposite to the end on a side of the sheet positional standard, is also attached, as well as the sheet reference plate 114, to the storage 104 so as to pass through an opening formed in the tray 103 to avoid interferences with moving up and down of the tray 103. The sheets S carried by the tray 103 are shifted to the sheet reference plate 114 by means of the sheet shifting plate 115 notwithstanding moving up and down of the tray 103.

With such a conventional art, however, since the tray 103 is suspended with clearance so as not to contact the storage 104 due to that the contact point between each pulley and the wire is located right above the fixed point between the tray 103 and the wire, or since the pulleys 112*a* to 112*d* are attached movably in the axial direction, the positions of the tray 103 in the axial direction of the pulley shafts 111*a* to 111*d* are uncertain.

This structure results in swayed-down movement of the tray 103 in the axial direction of the pulley where the storage 104 is pulled out of the frame 108 and where the tray 104 is moved down. If the connection points between the tray and the respective wires are shifted closer to a side indicated by arrow B in FIG. 11 than the points right above the respective contact points between the pulleys and the wires when the tray 103 is moved down to the bottom to load the sheets S, the tray 103 tends to move toward the far side from the sheet reference plate 114 when starting moving up. The sheets S are pressed by the sheet shifting plate 115 to the sheet reference plate 114. Although a shifting portion 115*a* is constituted so that a spring not shown pushes the sheets, feeding errors may occur due to resistance while the sheets are fed if the resilient force of the spring is set to a large amount. Where the resilient force is set to a regular amount, the sheets, if a large amount to be fed, are failed to be shifted at the shifting portion 105*a* of the sheet shifting plate 115, so that the end of the sheets S being carried may depart from the sheet reference plate 114. Accordingly, when the sheets S are fed by the feeding means under a condition that the sheets S are located away from the sheet reference plate 114, an image writing position in a direction perpendicular to the sheet feeding direction may be shifted and thereby impair the image quality.

SUMMARY OF THE INVENTION

The objection of the invention is to solve the problems on the prior art above and to provide a sheet feeding apparatus capable of shifting sheets at any time to a sheet reference side even though sheet carrying means moves up and down.

Representative means solving the problems on the prior art above, applied in the following embodiments, is characterized in that in a sheet feeding apparatus having sheet carrying means for carrying sheets suspended by suspending means, which is taken up by winding means and thereby moves the sheet carrying means up and down to render the sheets fed from the topmost side of sheets, pulleys located above the connection positions between the suspending means and the sheet carrying means, are located at positions, respectively, on a side of the sheet reference, more remote from the center of the sheets and, on a side opposite to the side of the sheet reference, closer to the center of the sheets than respective positions right above the connection positions between the suspending means and the sheet carrying means, in a direction perpendicular to a sheet feeding direction.

According to the above means, pulleys disposed above the connection positions between the suspending means and the sheet carrying means in an axial direction of the pulley are located at positions, respectively, on a side of the sheet reference, more remote from the center of the sheets and, on a side opposite to the side of the sheet reference, closer to the center of the sheets, so that the sheets carried on the sheet carrying plate can be shifted to the side of the sheet reference at any time notwithstanding moving up and down of a sheet carrying plate.

BRIEF DESCRIPTION OF THE DRAWINGS

The above and other objects and features of the invention are apparent to those skilled in the art from the following preferred embodiments thereof when considered in conjunction with the accompanied drawings, in which.

DETAILED DESCRIPTION OF PREFERRED EMBODIMENTS

[First Embodiment]

Figure 1:
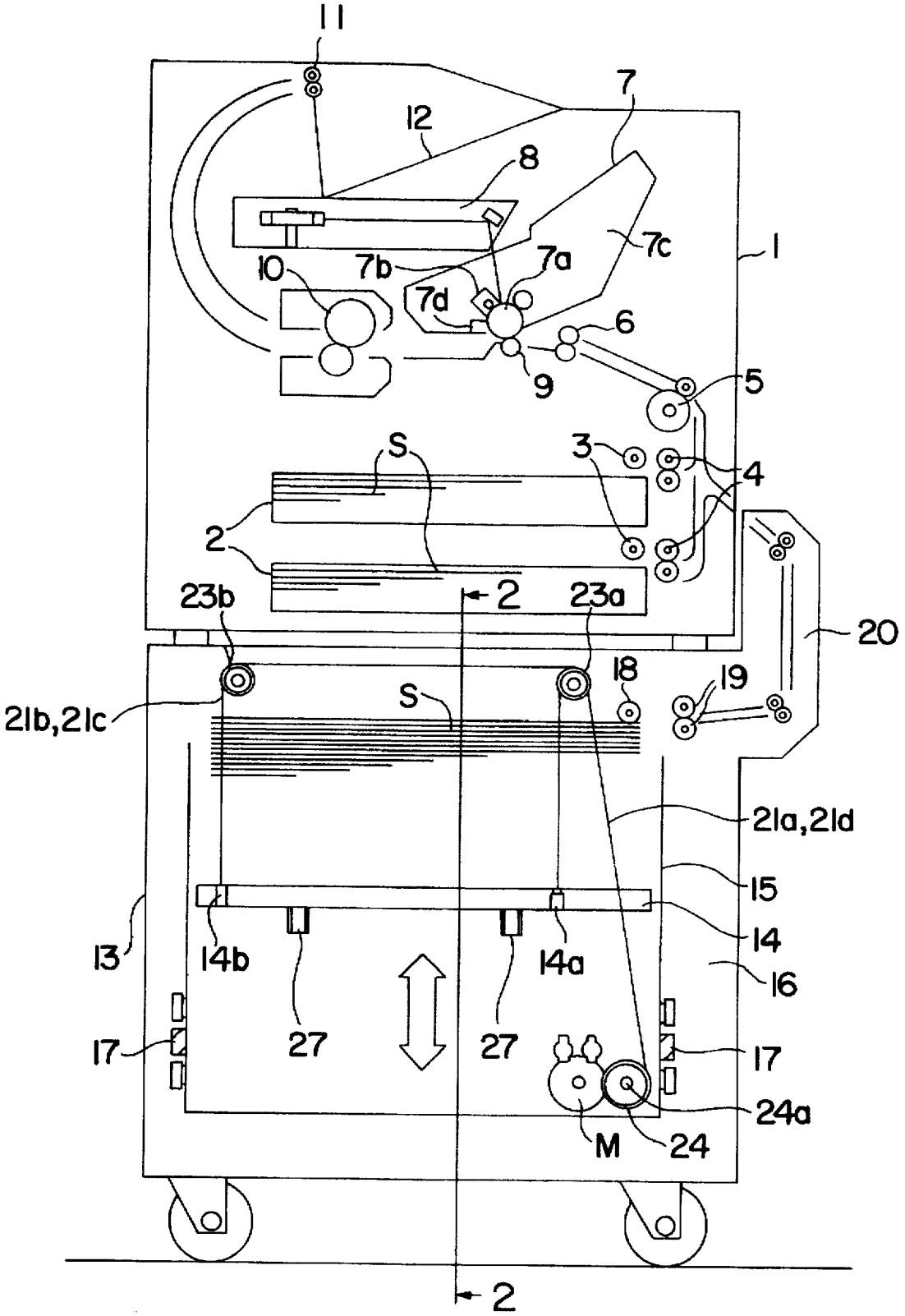
FIG. 1 is a cross section showing the entire structure of a laser printer and a sheet feeding apparatus according to the first embodiment.
Figure 2:
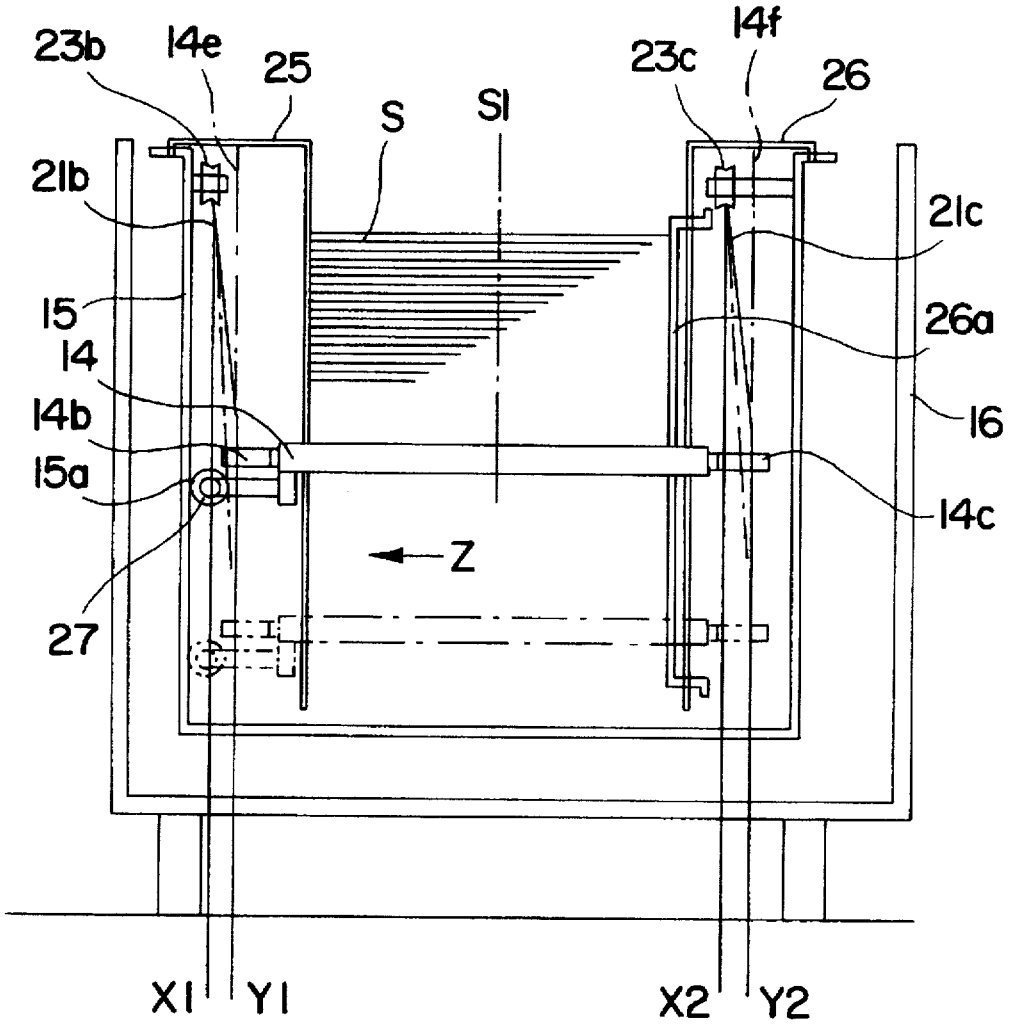
FIG. 2 is a cross section showing the sheet feeding apparatus taken along 2—2 line in FIG. 1.
Figure 3:
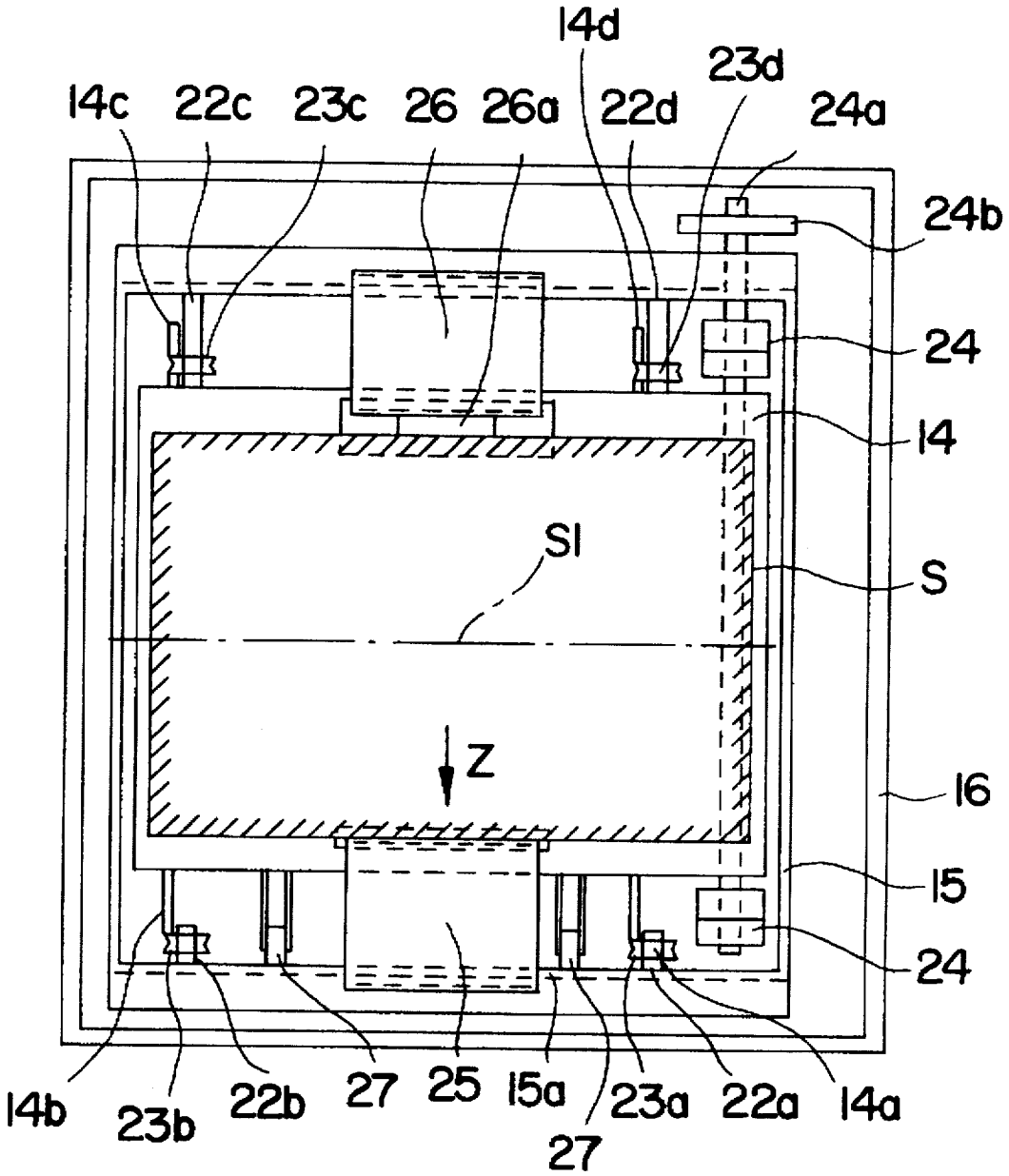
FIG. 3 is a top view showing the sheet feeding apparatus.

Hereinafter, referring to the drawings, an embodiment, to which the means above applies, of a sheet feeding apparatus according to the invention is described. Notedly, this embodiment is explained by using a laser printer installing the sheet feeding apparatus as an option. FIG. 1 is a cross section showing the entire structure of a laser printer and a sheet feeding apparatus according to the first embodiment; FIG. 2 is a cross section, taken along 2—2 line, of the sheet feeding apparatus shown in FIG. 1; FIG. 3 is a top view of the sheet feeding apparatus.

First, referring to FIG. 1, a structural outline of the laser printer and sheet feeding apparatus is described. The image forming apparatus 1 is a laser printer, or a laser beam printer (hereinafter, referred as to "LBP"), and has the following functions. Cassettes 2 containing and carrying sheets S are disposed within the image forming apparatus 1 and detachably attached in the form of upper and lower cassettes below the apparatus through the front side of the apparatus. A pickup roller 3 is disposed above the cassette 2, thereby feeding the sheets S put on the cassette 2 out from the topmost side of the sheets S. Pairs of retard rollers 4 are disposed so as to follow the pickup rollers 3, thereby separating and conveying, sheet by sheet, the sheets; S which had been fed out. As following those rollers 4, a roller pair 5 for feeding the separated sheet S and a register roller pair 6 for conveying the sheet S to the image forming section at a prescribed timing after skew collection by striking the front end of the sheet S to a nip portion, are disposed within the apparatus.

A process cartridge 7 incorporating known process means relating to image formation is located over the feeding system and detachably attached to the apparatus body. Within the process cartridge 7, incorporated are a photosensitive drum 7*a*, a charging unit 7*b*, a developing unit 7*c*, a cleaning unit 7*d*, and the like. Laser beam is radiated from a laser exposure device 8 onto the photosensitive drum 7*a* according to image information, thereby performing writing. A transfer roller 9 is in pressurized contact with the photosensitive drum 7*a* and transfers a developed image (toner image) onto the sheet S when the sheet S passes between the photosensitive drum 7*a* and the transfer roller 9. A fixing unit 10 is disposed in the proximity of the process cartridge 7 to fix the transferred image onto the sheet by application of heat and pressure onto the sheet S after image is transferred. The sheet S to which image has been transferred is conveyed through a reversing path and delivered by delivery roller pair 11 onto a delivery tray 12 formed on the top of the apparatus in a manner that image formed side faces down (face down).

In the sheet feeding apparatus, the sheet feeding apparatus 13 uses a base of the LBP 1 commonly, and is disposed below the LBP 1. The sheet feeding apparatus 13 contains cumulated sheets S in a relatively large size which cannot be contained in the cassettes 2 and can supply a large amount of sheets S to the LBP 1.

A tray 14 movable up and down in carrying the sheets S is installed in the storage 15 capable of being drawn for loading the sheets S. The storage 15 is supported by rail-shaped guides 17 arranged in the frame 16 on both sides of the frame 16 and is constituted so as to be capable of being drawn to the front side of the apparatus along the guides 17. Provided on the frame 16 are a pickup roller 18 for feeding sheets S on the tray 14 from the topmost side of the sheets S, one or more of retard roller pair 19 for separating and further feeding the supplied sheets S sheet by sheet, a conveyer 20 for feeding the separated sheet S to the LBP 1.

In FIG. 3, the tray 14 is suspended in the storage 15 by wires 21*a* to 21*d*, serving as suspending means, which are secured to the respective vicinities of the four corners of the tray 14. The other end of each wire is connected to respective winding winches 24 placed on front and rear sides through respective pulleys 23*a* to 23*d* rotatably attached to pulley shafts 22*a* to 22*d* which are fixed to the storage 15. Although the pulleys 23*a* to 23*d* are rotatably attached to the pulley shafts 22*a* to 22*d*, the pulleys cannot move in the axial direction.

The winding winches 24 are secured to a single shaft around which a gear 24*a* is attached. Where the storage 15 is attached to the frame 16, the gear 24*a* is in mesh with a gear of a motor M formed at the frame 16. The winding winches 24 are rotated by drive of the motor M, thereby winding the respective wire on the body of the winding winches 24 to move the tray 14 up. When the storage 15 is drawn from the frame 16, the gear 24*a* of the winding winches 24 is disengaged from the gear of the motor M secured to the frame 16, so that the tray 14 moved down due to weight of the tray 14 and the sheets S.

The frame 16 is formed with detecting means not shown for detecting the top of tray 14 (or the top of paper) moving up; when the detecting means detects the top of tray 14 (or the top of paper) moving up, the drive of the motor M which rotates the winding winches 24 is stopped. To the contrary, when the top of paper comes lower by sending the sheets S out in use of the pickup roller 18 and the retard roller pairs 19 arranged on the frame 16, the motor M is driven again to move the tray 14 up until the detecting means detects the top of paper.

In FIG. 2, a sheet reference plate 25 serving as a sheet positional reference is formed on a front side (the left side in FIG. 2) in a direction perpendicular to the feeding direction of the sheets S in the storage 15. The sheet reference plate 25 is attached to the storage 15 through an opening formed in the tray 14 to prevent interferences with moving up and down of the tray 14. A sheet shifting plate 26 for shifting the sheets to the sheet positional reference by pushing the opposite end of the sheets to the side of the sheet positional reference is provided on a rear side (the right side in FIG. 2) in a direction perpendicular to the feeding direction of the sheets S in the storage 15. The sheet shifting plate 26, as well as the sheet reference plate 25, is also attached to the storage 15 through an opening formed in the tray 14 to prevent interferences with moving up and down of the tray 14. The sheets S conveyed on the tray 14 can be shifted up to the sheet reference plate 25 by the sheet shifting plate 26, notwithstanding moving up and down of the tray 14.

The sheets S stacked on the tray 14 (in the deck) are to be sent by using the center of the sheets as the reference. The sheet shifting plate 26 is arranged in opposition to the sheet reference plate 25 with respect to the sheets S. A shifting member **26*a* biased toward the side of the sheet reference plate 25 by a spring not shown is formed at the sheet shifting plate 26. Notedly, the sheet reference plate 25 and the sheet shifting plate 26 are attached movably in left and right directions in FIG. 2** in accordance with size of the sheets S to be contained.

With this constitution, the pulleys **23*a*, 23*b* disposed on a side of the sheet reference plate 25 serving as the sheet positional reference in a direction perpendicular to the feeding direction of the sheets S are, as shown in FIG. 2, located at a position in the axial direction (referred as to "X1") on a side (or the left side in FIG. 2) that the pulley's groove at least becomes remote from the center S1 of the sheet with respect to vertical lines 14*e* drawn from wire connection points 14*a*, 14*b* (referred as to "Y1") at which wires 21*a*, 21*b* are connected to the tray 14. The pulleys 23*c*, 23*d* disposed on a side of the sheet shifting plate 26 for pushing the sheets S to the sheet reference plate 25 are, as shown in FIG. 2, located at a position in the axial direction (referred as to "X2") on a side (or the left side in FIG. 2) that the pulley's groove at least becomes close to the center S1 of the sheet with respect to vertical lines 14*f* drawn from wire connection points 14*c*, 14*d* (referred as to "Y2") at which wires 21*c*, 21*d* are connected to the tray 14**.

A roller 27 is rotatably attached to a side face of the tray 14 on a side of the sheet reference plate 25. By contacting the roller 27 to the inner side face **15*a* of the storage 15, the clearance between the tray 14 and the storage 15 is kept constant, and sliding friction when the tray 14** moves up and down is reduced.

That is, as shown in FIG. 2, the connection points Y1, Y2 between the tray 14 and the respective wires **21*a* to 21*d* and the contact points X1, X2 of the pulleys 23*a* to 23*d* are made offset, thereby biasing the tray 14 toward Z direction at any time according to the principle of pendulum in assuming that the contact points X1, X2 between the pulleys and the wires are centers and that the connection points Y1, Y2 between the tray and wires are pendulums, and thereby being capable of shifting the conveyed sheets S toward the side of the sheet reference plate 25 not only by the pushing force of the sheet shifting plate 26 but also by the entire tray. Where the tray 14 reaches the bottom while conveying sheets, the sheets S never separate from the sheet reference plate 25 even if the tray 14 starts moving up, because the tray 14 is shifted toward the side of the sheet reference plate 25**. Consequently, the apparatus can make the sheet conveyance position stable, avoid positional deviations of image writing at a time of image formation, improve recording accuracy, and provide high quality images.

[Second Embodiment]

Figure 4:
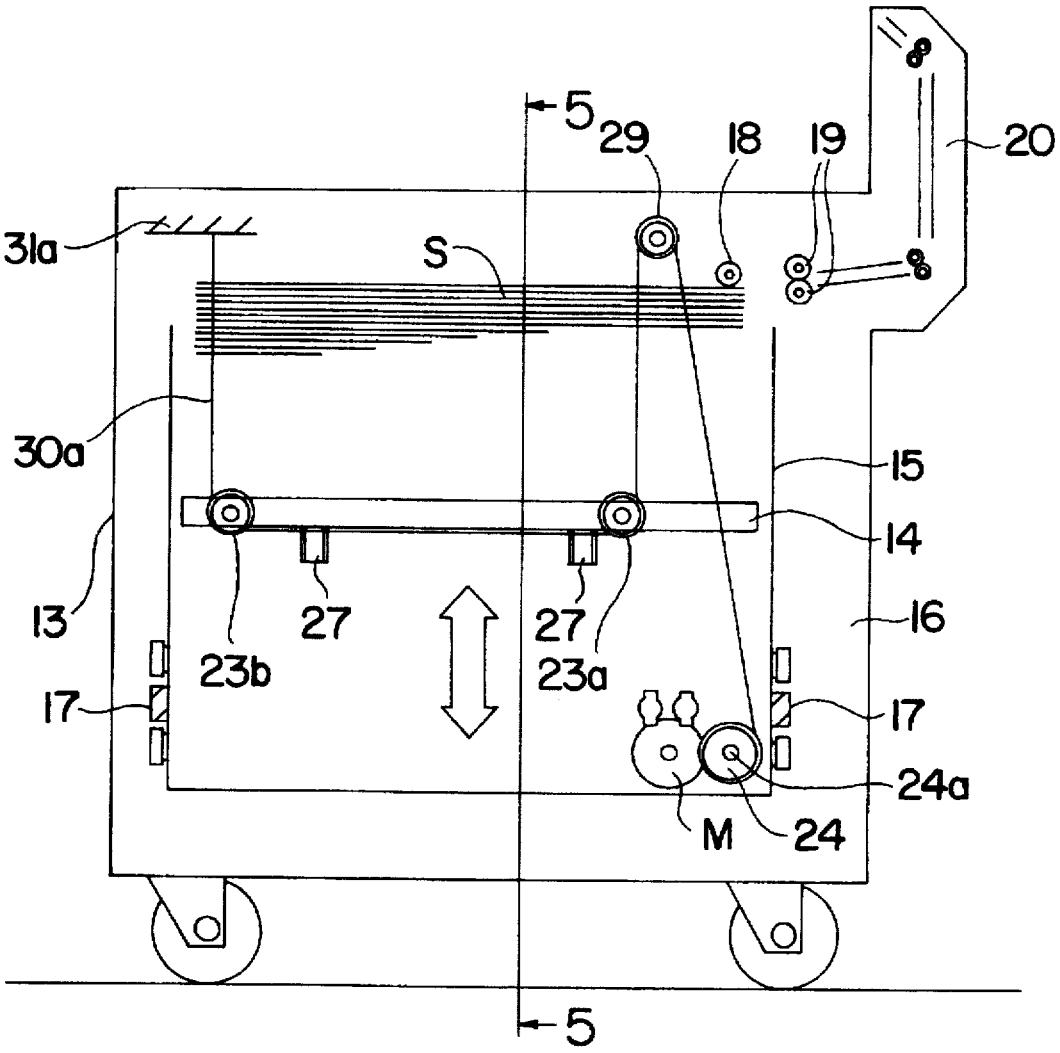
FIG. 4 is a cross section showing the entire structure of a sheet feeding apparatus according to the second embodiment.
Figure 5:
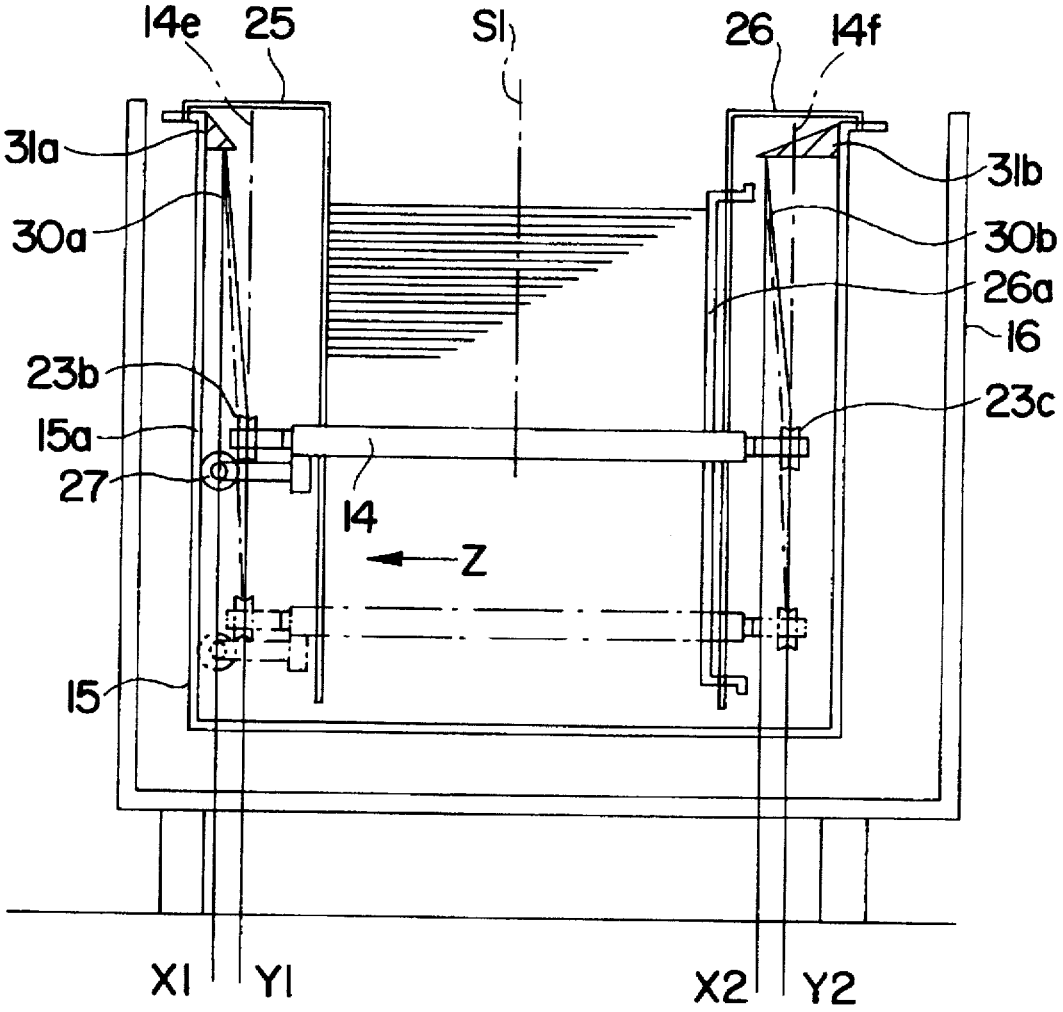
FIG. 5 is a cross section showing the sheet feeding apparatus taken along 5—5 line in FIG. 4.
Figure 6:
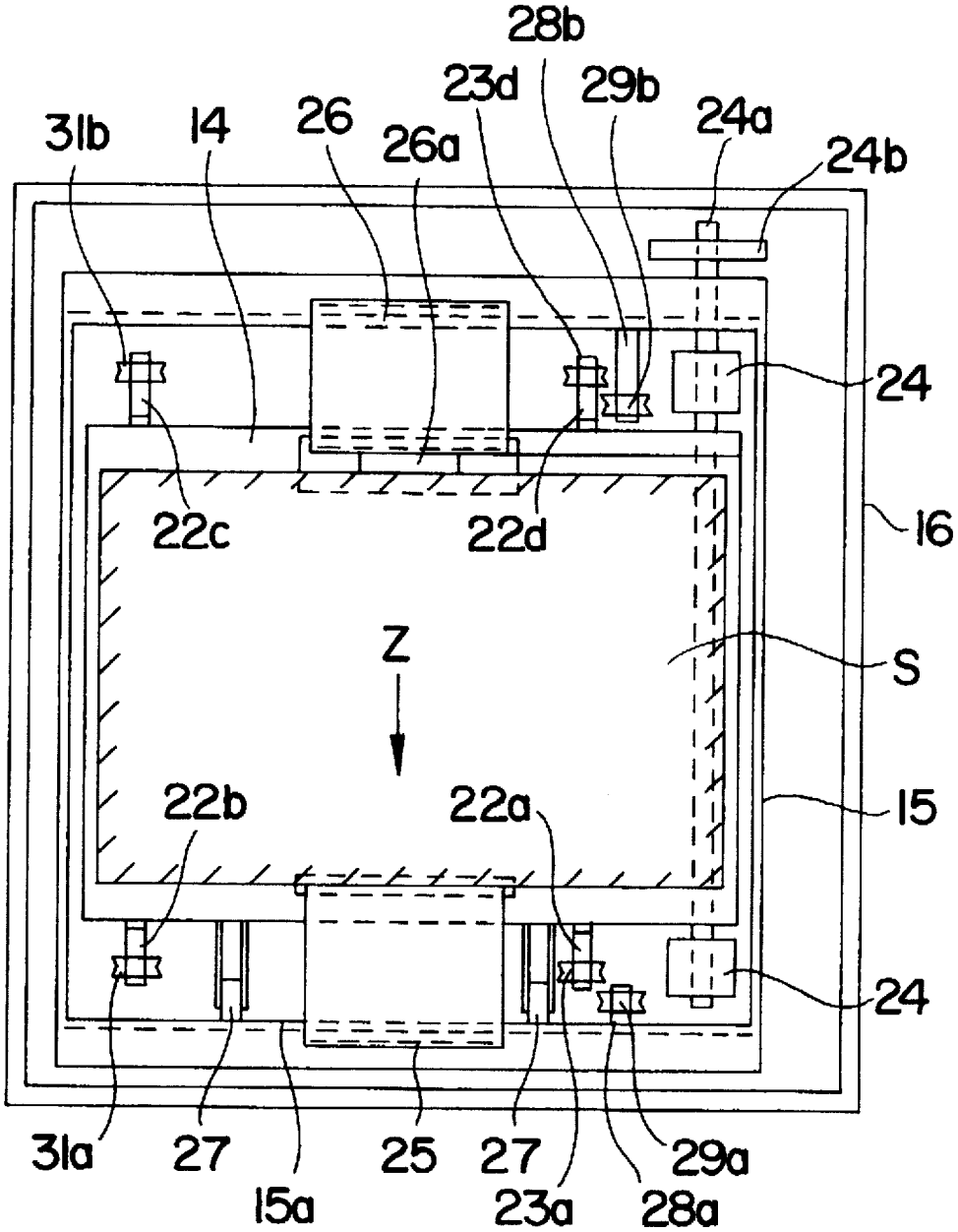
FIG. 6 is a top view showing the sheet feeding apparatus.

Referring now to FIGS. 4 to 6, another embodiment of the sheet feeding apparatus is described. FIG. 5 is a cross section taken along 5—5 line in FIG. 4. Notedly, since the structural outline of the sheet feeding apparatus is substantially same as that of the first embodiment, the same members as those in the first embodiment are assigned with the same numbers, and descriptions of those members are omitted. Hereinafter, essentially, featured portions are described.

In FIGS. 4, 6, pulley shafts **22*a*, 22*b* are respectively arranged so as to project from a side face of the tray 14 for conveying sheets S on a side of the sheet reference plate 25; pulley shafts 22*c*, 22*d* are respectively arranged so as to project from a side face of the tray 14 on a side of the sheet shifting plate 26. Attached rotatably on the pulley shafts 22*a* to 22*d* are pulleys 23*a* to 23*d*, respectively. Pulley shafts 28*a*, 28*b* are arranged so as to project from an inner side face of the storage 15, and pulleys 29*a*, 29*b* are rotatably attached to the pulley shafts 28*a*, 28*b***.

One end of a wire **30*a* on the side of the sheet reference plate 25 is secured to a fixing 31*a* arranged on a ceiling of the storage 15; the other end is coupled to the winding winch 24 by way of the pulleys 23*a*, 23*b* secured to the tray 14 and the pulley 29*a* secured to the storage 15. Similarly, one end of a wire 30*b* on the side of the sheet shifting plate 26 is secured to a fixing 31*b* arranged on a ceiling of the storage 15; the other end is coupled to the winding winch 24 by way of the pulleys 23*c*, 23*d* secured to the tray 14 and the pulley 29*b* secured to the storage 15**.

As shown in FIG. 5, the connection point between the wire **30*a* and the storage 15 and the contact point between the wire 30*a* and the pulley 29*a* are located on a side to be remote from the center S1 of the sheet (the left direction in FIG. 5) with respect to vertical lines 14*e* drawn from the contact points between the wire 30*a* and the pulleys 23*a*, 23*b*. Similarly, the connection point between the wire 30*b* and the storage 15 and the contact point between the wire 30*b* and the pulley 29*b* are located on a side to be close to the center S1 of the sheet (the left direction in FIG. 5) with respect to vertical lines 14*f* drawn from the contact points between the wire 30*b* and the pulleys 23*c*, 23*d***.

A roller 27 is rotatably attached to a side face of the tray 14 on a side of the sheet reference plate 25. By contacting the roller 27 to the inner side face **15*a* of the storage 15, the clearance between the tray 14 and the storage 15 is kept constant, and sliding friction when the tray 14** moves up and down is reduced.

With the constitution above, the tray 14 is shifted to the side of the shift reference plate 25 at any time, and the sheets S conveyed on the tray 14 are also shifted to the sheet reference plate 25 notwithstanding moving up and down of the tray 14.

[Third Embodiment]

Figure 7:
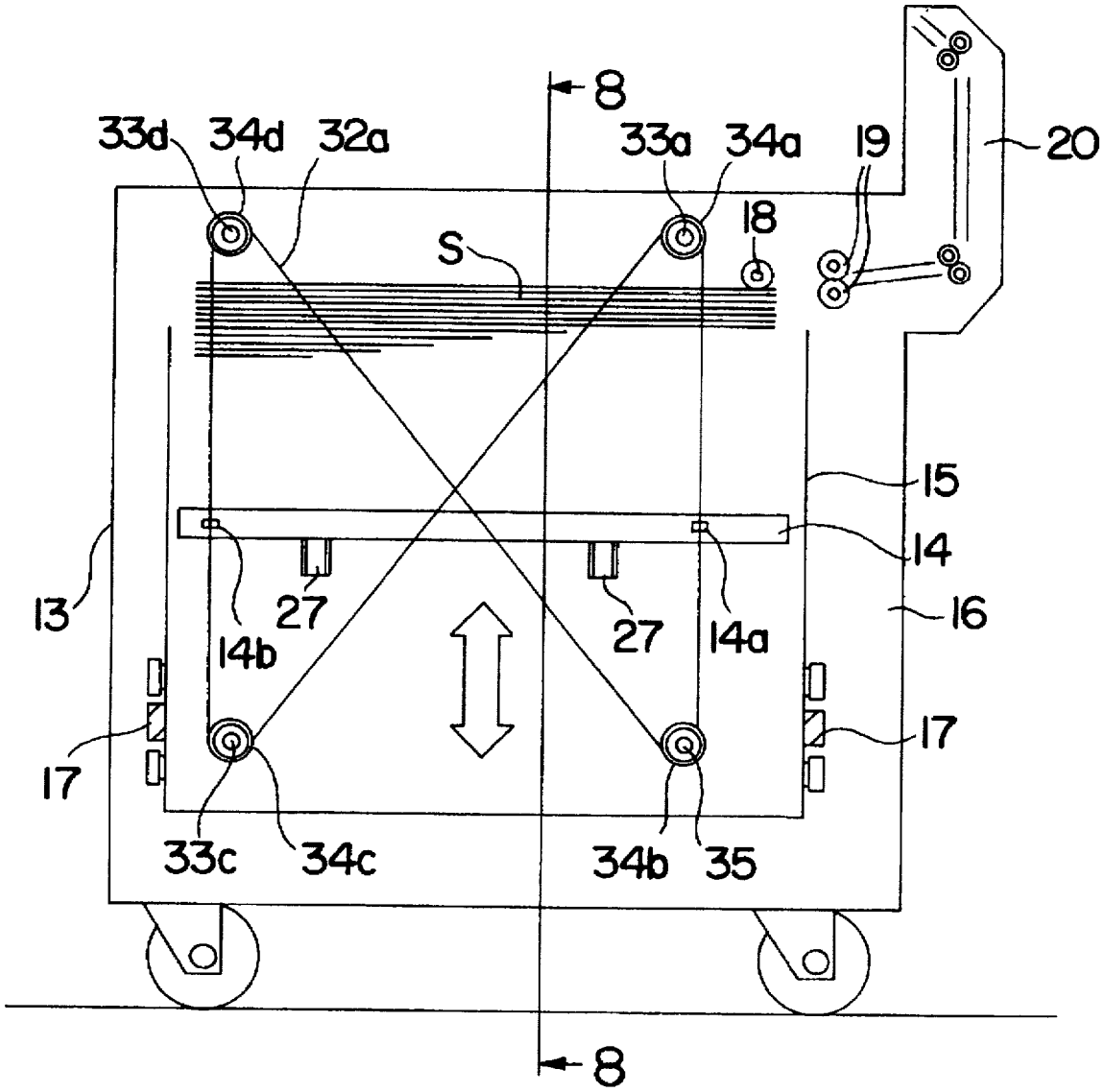
FIG. 7 is a cross section showing the entire structure of a sheet feeding apparatus according to the third embodiment.
Figure 8:
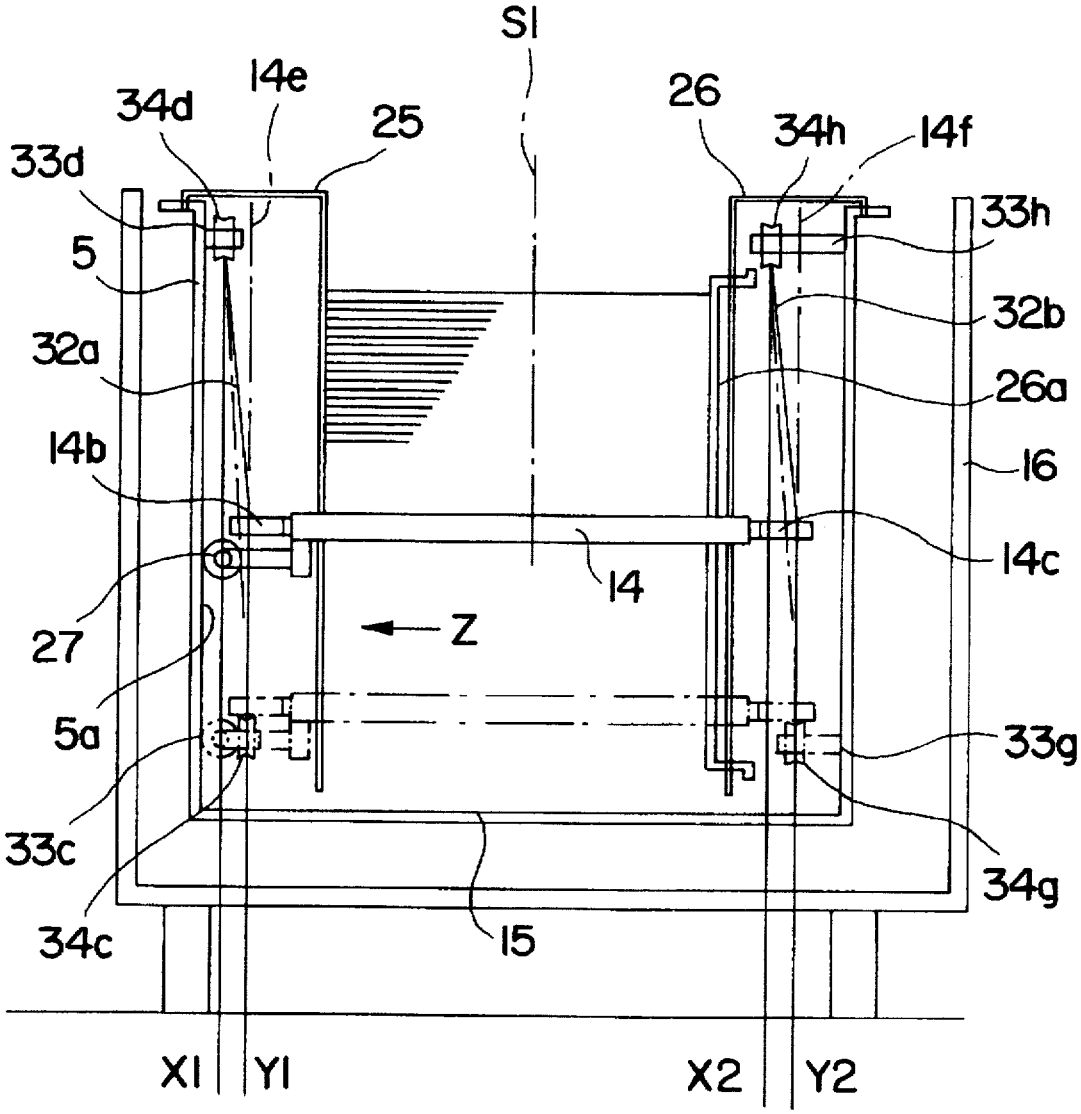
FIG. 8 is a cross section showing the sheet feeding apparatus taken along 8—8 line in FIG. 7.
Figure 9:
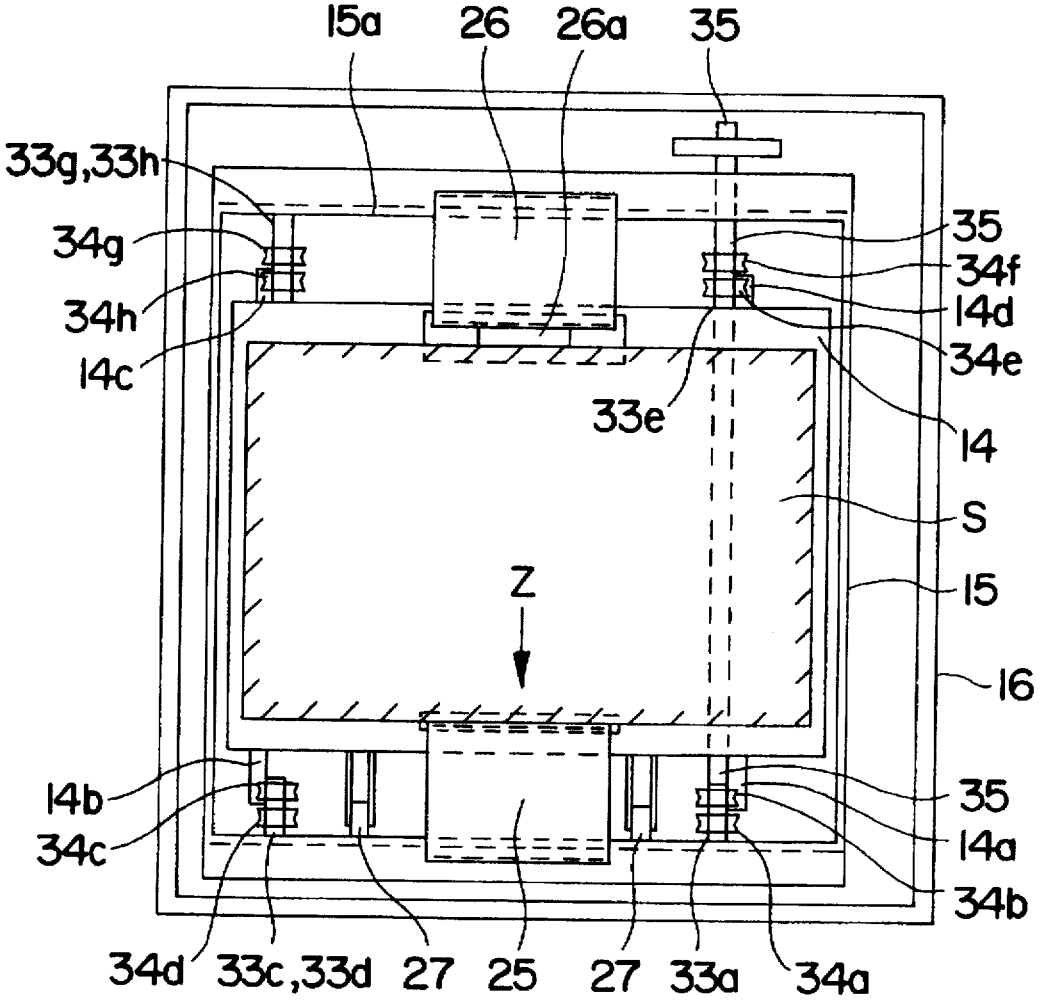
FIG. 9 is a top view showing the sheet feeding apparatus.
Figure 10:
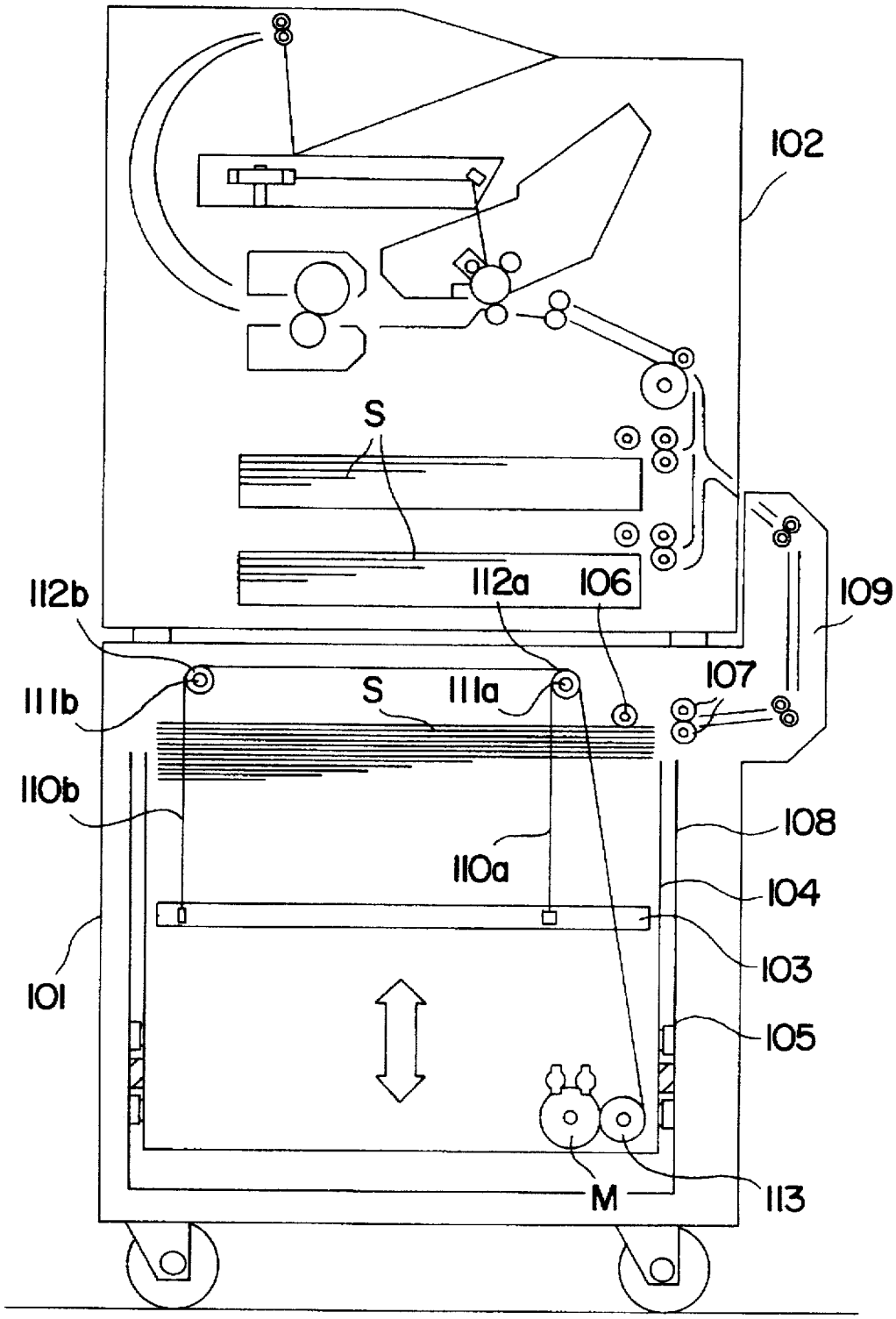
FIG. 10 PRIOR ART
FIG. 10 is an illustration showing a laser printer and a sheet feeding apparatus of the prior art.
Figure 11:
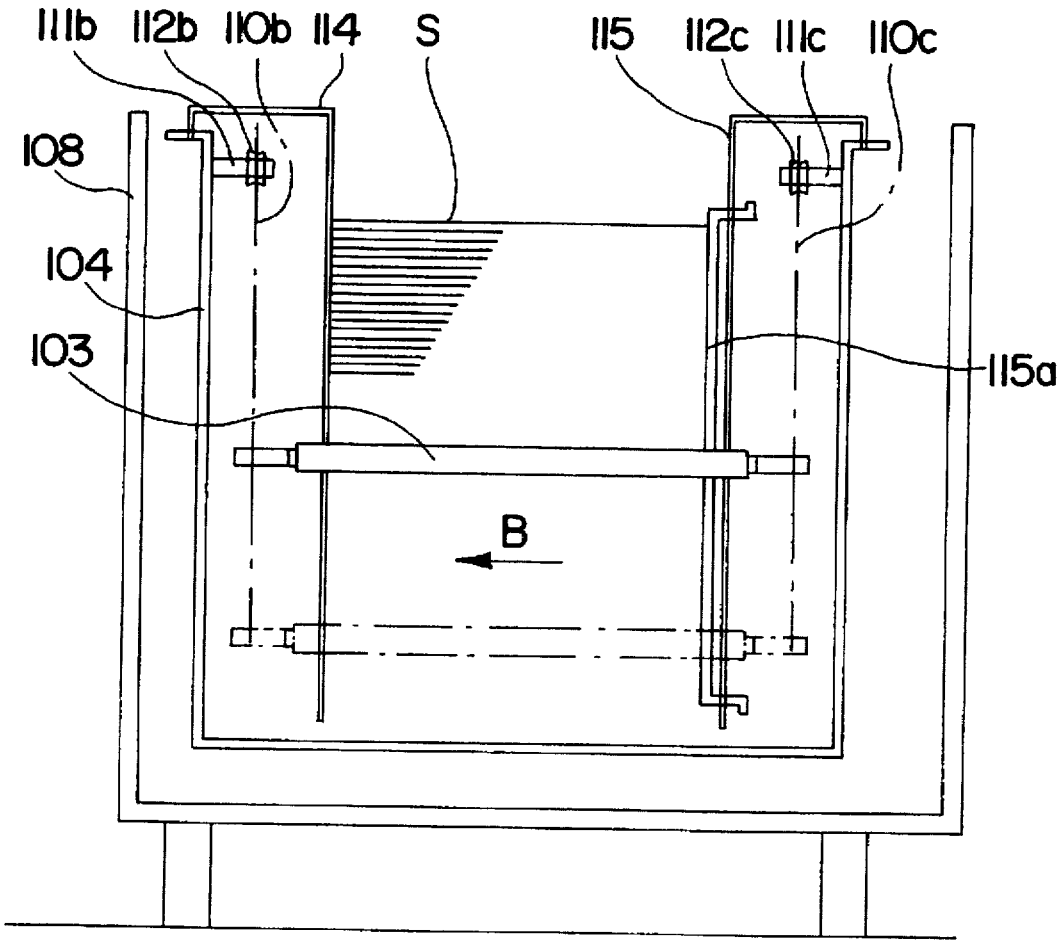
FIG. 11 PRIOR ART
FIG. 11 is a cross section of the sheet feeding apparatus of the prior art.
Figure 12:
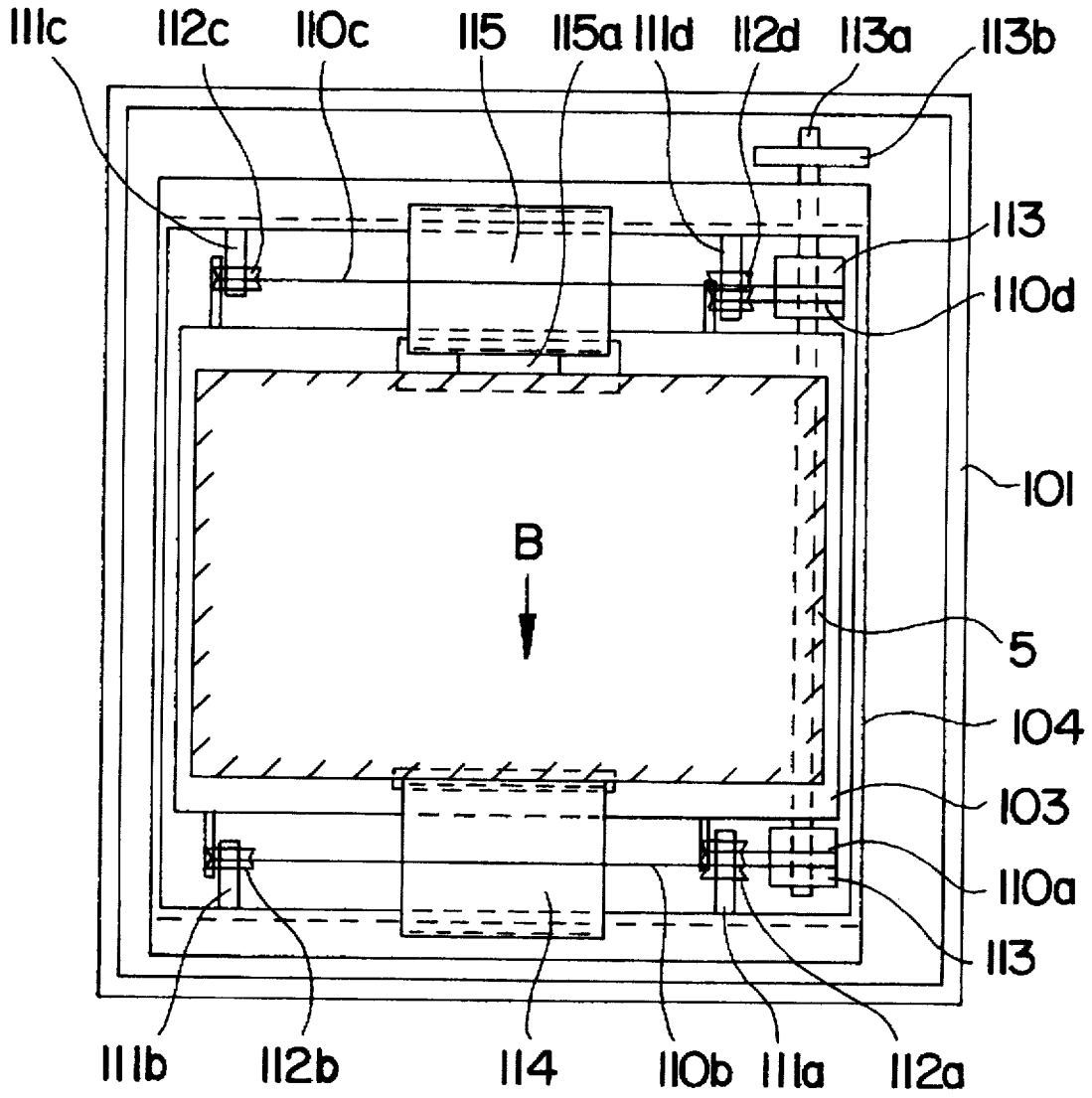
FIG. 12 PRIOR ART
FIG. 12 is a top view of the sheet feeding apparatus of the prior art.

Referring now to FIGS. 7 to 9, another embodiment of the sheet feeding apparatus is described. FIG. 8 is a cross section taken along 8—8 line in FIG. 7. Notedly, since the structural outline of the sheet feeding apparatus is substantially same as that of the first embodiment, the same members as those in the first embodiment are assigned with the same numbers, and descriptions of those members are omitted. Hereinafter, essentially, featured portions are described.

In FIGS. 7, 9, a wire 32*a* located on a side of the sheet reference plate 25 is tensioned in the form of number eight by pulleys 34*a*, 34*c*, 34*d* rotatably attached to the pulley shafts 33*a*, 33*c*, 33*d* projected from the inner surface 15*a* of the storage 15 and by a pulley 34*b* fixed to a through-shaft 35 having at an end thereof a gear to which drive force is transmitted. Similarly, a wire 32*b* located on a side of the sheet shifting plate 26 is tensioned in the form of number eight by pulleys 34*e*, 34*g*, 34*h* rotatably attached to the pulley shafts 33*e*, 33*g*, 33*h* projected from the inner surface 15*a* of the storage 15 and by a pulley 34*f* fixed to a through-shaft 35 having at an end thereof a gear to which drive force is transmitted.

The tray 14 conveying the sheets S are suspended securely by the wires 32*a*, 32*b* so as to level at the wire coupling portions 14*a* to 14*d* coupled to the tray 14 and located, on the side of the sheet reference plate 25, in sections of the wire 32*a* between the pulleys 34*a*, 34*b* and between the pulleys 34*c*, 34*d* and, on the side of the sheet shifting plate 26, in sections of the wire 32*b* between the pulleys 34*e*, 34*f* and between the pulleys 34*g*, 34*h*. The tray 14 is constituted so that the tray 14 secured to the wires moves up and down by rotations of the wires 32*a*, 32*b* in prescribed directions upon normal and reverse rotations of the through-shaft 35 to which the pulleys 34*b*, 34*f* are attached.

As shown in FIG. 8 and 9, the pulleys 34*a*, 34*d* located over the wire coupling portions 14*a*, 14*b* are disposed on a side remote from the center S1 of the sheets (in the left direction in FIG. 8) with respect to the vertical lines 14*e* drawn from the wire coupling portions 14*a*, 14*b*, and the pulleys 34*e*, 34*h* located over the wire coupling portions 14*c*, 14*d* are disposed on a side close to the center S1 of the sheets (in the left direction in FIG. 8) with respect to the vertical lines 14*f* drawn from the wire coupling portions 14*c*, 14*d*.

A roller 27 is rotatably attached to a side face of the tray 14 on a side of the sheet reference plate 25. By contacting the roller 27 to the inner side face 15*a* of the storage 15, the clearance between the tray 14 and the storage 15 is kept constant, and sliding friction when the tray 14 moves up and down is reduced.

With the constitution above, the tray 14 is shifted to the side of the shift reference plate 25 at any time, and the sheets S conveyed on the tray 14 can be moved up and down without being apart from the sheet reference plate 25.

It is to be noted that although in the first to third embodiments, an electrophotographic method using a photosensitive drum serving as image forming means is used, this invention is not limited to this, but as a matter of course inclusive of image forming means such as an ink jet method and thermal transfer method. Although those embodiments illustrated the LBP as an image forming apparatus, other apparatuses such as a photocopier, a facsimile apparatus, or the like can be used.

According to the invention described above, the pulleys located over the connection position between the suspending means and the sheet carrying means are disposed, on the sheet reference side, on a side remote from the sheet center and, on the side opposite to the sheet reference side, on a side close to the sheet center, so that the cumulated sheets can be shifted to the reference side not only by the pushing force of the sheet shifting plate but also by the entire sheets and the tray, and so that the sheets on the tray can be shifted to the sheet reference side at any time notwithstanding moving up and down of the tray.

Therefore, the sheet feeding apparatus can make the sheet carrying position stable, write images without any positional shift when image is formed, and improve recording accuracy to provide high quality images.

The foregoing description of a preferred embodiment of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not to be limited by the specification, but be defined by the claims set forth below.

What is claimed is:

1. A sheet feeding apparatus comprising:

sheet carrying means, suspended on both sides in a direction perpendicular to a sheet feeding direction by suspending means, for carrying sheets;

winding means for winding the suspending means, thereby moving the sheet carrying means up and down;

sheet reference means disposed at one end of the sheets carried on the sheet carrying means in a direction perpendicular to a sheet feeding direction for aligning the sheets; and sheet feeding means for feeding out a topmost sheet of the sheets on the sheet carrying means along the sheet reference means;

wherein a connection position at an intersection of the suspending means and the sheet carrying means, at a position on a side of the sheet reference means, is located closer to a center of the sheets with respect to a position of a suspending original point of the suspending means located on the same side of the sheet reference means and over the sheet carrying means; and other connection positions at an intersection of the suspending means and the sheet carrying means at a position on an opposite side of the sheet reference means are located remote from the center of the sheets with respect to a position of a suspending original point on the suspending means located on the opposite side of the sheet reference means and over the sheet carrying means.

2. The sheet feeding apparatus according to claim 1, wherein the suspending means is a wire and the winding means is a winch.

3. The sheet feeding apparatus according to claim 2, wherein the wire is connected to the sheet carrying means by way of a pulley, and wherein the suspending original points are positions at which the wire is wound around the pulley.

4. The sheet feeding apparatus according to claim 1, wherein the sheet reference means is a reference plate to which an end, on the side of the sheet reference plate, of the sheets carried on the sheet carrying means contacts, and the sheet reference plate is attached to a frame of the sheet feeding apparatus.

5. The sheet feeding apparatus according to claim 4, further including a sheet shifting plate for pushing an end of the sheets carried on the sheet carrying means toward the side of the sheet reference means.

6. The sheet feeding apparatus according to claim 1, wherein an extension portion projecting from the sheet carrying means toward a frame of the sheet feeding apparatus is formed.

7. The sheet feeding apparatus according to claim 6, wherein a roller is attached to the tip of the extension portion.

8. An image forming apparatus comprising:

sheet carrying means, suspended on both sides in a direction perpendicular to a sheet feeding direction by suspending means, for carrying sheets;

winding means for winding the suspending means, thereby moving the sheet carrying means up and down;

sheet reference means disposed at one end of the sheets carried on the sheet carrying means in a direction perpendicular to a sheet feeding direction for aligning the sheets;

sheet feeding means for feeding out a topmost sheet of the sheets on the sheet carrying means along the sheet reference means; and image forming means for forming images on the sheet fed by the sheet feeding means in accordance with image information;

wherein a connection position at an intersection of the suspending means and the sheet carrying means, at a position on a side of the sheet reference means, is located closer to a center of the sheets with respect to a position of a suspending original point of the suspending means located on the side of the sheet reference means and over the sheet carrying means, and another connection position at an intersection of the suspending means and the sheet carrying means, at a position on an opposite side of the sheet reference means, is located remote to the center of the sheets with respect to a position of another suspending original point of the suspending means located on an opposite side of the sheet reference means and over the sheet carrying means.

9. A sheet feeding apparatus comprising:

a tray for carrying sheets;

a plurality of wires suspending the tray by connecting at respective connection positions to the tray on both sides in a direction perpendicular to a sheet feeding direction;

a winding device for moving the tray up and down by winding the wires;

a plurality of pulleys located over the connection positions between the winding device and the tray, wherein the wires are wound around the pulleys connected between the tray and the winding device;

a sheet reference member disposed at one end of the sheets carried on the tray in a direction perpendicular to a sheet feeding direction; and a sheet feeding roller for feeding out a topmost sheet of the sheets on the tray along the sheet reference member;

wherein a connection position at an intersection of one of the wires and the tray is made offset, at a position on a side of a sheet reference established by the sheet reference member toward the center of the sheets with respect to a position of a respective one of the pulleys located on the side of the sheet reference member; and, another connection position at an intersection of one of the wires and the tray is made offset, at a position on a side opposite to the side of the sheet reference, away from the center of the sheets with respect to a position of another one of the pulleys located on the opposite side of the sheet reference member.

10. An image forming apparatus comprising:

a tray for carrying sheets;

a plurality of wires suspending the tray by connecting respective connection portions to the tray on both sides in a direction perpendicular to a sheet feeding direction;

a winding device for moving the tray up and down by winding the wires;

a plurality of pulleys located over the connection positions between the wires and the tray, wherein the wires are wound around the pulleys and connected to the winding device;

a sheet reference member disposed at one end of the sheets carried on the tray in a direction perpendicular to a sheet feeding direction;

sheet feeding roller for feeding out a topmost sheet of the sheets on the tray along the sheet reference member; and image forming means for forming an image on the sheet fed by the sheet feeding roller;

wherein a connection position at an intersection of one of the wires and the tray is made offset, at a position on a side of the sheet reference member toward the center of the sheets with respect to a position of one of the pulleys located on the side of the sheet reference member and, another connection position at an intersection of another one of the wires and the tray is made offset, at a position on an opposite side of the sheet reference member, away from the center of the sheets with respect to a position of another one of the pulleys located on the opposite side of the sheet reference member.

11. A sheet feeding apparatus comprising:

sheet carrying means for carrying sheets;

suspending means for suspending the sheet carrying means;

winding means for winding the suspending means, thereby moving the sheet carrying means up and down;

sheet reference means disposed at one end of the sheets carried on the sheet carrying means in a direction perpendicular to a sheet feeding direction for aligning the sheets; and sheet feeding means for feeding out a topmost sheet of the sheets on the sheet carrying means along the sheet reference means;

wherein the suspending means moves the sheet carrying means in the direction perpendicular to the sheet feeding direction so that the edges of the sheets carried on the sheet carrying means are abutted against the sheet reference means when the sheet carrying means moves up by winding the suspending means by the winding means.

12. The sheet feeding apparatus according to claim 11, further comprising regulation means for regulating movement of the sheet carrying means in the direction perpendicular to the sheet feeding direction.

13. The sheet feeding apparatus according to claim 12, wherein the regulating means comprises a roller attached to a tip end of a extension portion formed on the sheet carrying means, the roller is abutted to a frame of the sheet feeding apparatus so as to regulate movement of the sheet carrying means in the direction perpendicular to the sheet feeding direction.

14. An image forming apparatus comprising:

sheet carrying means for carrying sheets;

suspending means for suspending the sheet carrying means;

winding means for winding the suspending means, thereby moving the sheet carrying means up and down;

sheet reference means disposed at one end of the sheets carried on the sheet carrying means in a direction perpendicular to a sheet feeding direction for aligning the sheet;

sheet feeding means for feeding out a topmost sheet of the sheets on the sheet carrying means along the sheet reference means; and image forming means for forming an image on a sheet fed by the sheet feeding roller;

wherein the suspending means moves the sheet carrying means in the direction perpendicular to the sheet feeding direction so that the edges of the sheets carried on the sheet means are abutted against the sheet reference means when the sheet carrying means moves up by winding the suspending means by the winding means.

* * * * *

UNITED STATES PATENT AND TRADEMARK OFFICE

CERTIFICATE OF CORRECTION

PATENT NO. : 5,700,006

DATED : December 23, 1997

INVENTOR(S) : Narukazu SEKIYA, et al.

It is certified that error appears in the above-indentified patent and that said Letters Patent is hereby corrected as shown below:

Column 2, line 37, after "amount", insert --is--; and delete "are failed" and insert therefor --fail--;
Line 48, delete "objection" and insert therefor --object--; and delete "on" and insert therefor --of--;
Line 52, delete "on" and insert therefor --of--.

Column 3, line 61, delete "as to" and insert therefor --to as--.

Column 4, line 3, delete the semicolon (";") after "sheets".

Column 5, lines 44 and 48, delete "as to", both occurrences, and insert therefor --to as--.

Column 6, line 22, after "substantially", insert --the--.

Column 7, line 9, after "substantially", insert --the--.

Column 10, line 20, delete "portions" and insert therefor --positions--.

UNITED STATES PATENT AND TRADEMARK OFFICE

CERTIFICATE OF CORRECTION

PATENT NO. : 5,700,006

DATED : December 23, 1997

INVENTOR(S) : Narukazu SEKIYA, et al

It is certified that error appears in the above-indentified patent and that said Letters Patent is hereby corrected as shown below:

Column 12, line 6, delete "sheet" and insert therefor --sheets--.

Signed and Sealed this

Twenty-third Day of June, 1998

Bruce Lehman

*Attest:*

BRUCE LEHMAN

*Attesting Officer*

*Commissioner of Patents and Trademarks*